United States Patent [19]

Matter et al.

[11] 4,225,092

[45] Sep. 30, 1980

[54] ANNULAR GRINDING MILL

[75] Inventors: Frank A. Matter, Buchs; Hans E. Brunner, Birr-Lupfig, both of Switzerland

[73] Assignee: Microprocess Ltd., Buchs, Switzerland

[21] Appl. No.: 939,995

[22] Filed: Sep. 6, 1978

[30] Foreign Application Priority Data

Nov. 22, 1977 [CH] Switzerland ..... 14233/77

[51] Int. Cl.[3] ..... B02C 23/36

[52] U.S. Cl. ..... 241/46 B; 241/46.17; 241/172

[58] Field of Search ..... 241/46 R, 46 B, 46.11, 241/46.17, 170, 172

[56] References Cited

U.S. PATENT DOCUMENTS

| | | | |
|---|---|---|---|
| 1,956,293 | 4/1934 | Klein et al. | |
| 2,779,752 | 1/1957 | Vining . | |
| 3,149,789 | 9/1964 | Szegvari . | |
| 3,185,398 | 5/1965 | Hughes et al. | |
| 3,298,618 | 1/1967 | Talpey | 241/172 X |
| 3,423,032 | 1/1969 | Eckert | 241/46 R |
| 3,591,362 | 7/1971 | Benjamin | 241/46.17 |

FOREIGN PATENT DOCUMENTS 1184188 12/1964 Fed. Rep. of Germany .

1214516 8/1967 Fed. Rep. of Germany .

OTHER PUBLICATIONS

"Microprocess Wet Growing System," Microprocess Inc.

"Microprocess," Microprocess A.G.

"New Type of Mill for Refined Chemicals," H. Tanner, Industrial and Engr. Chemistry, vol. 49, No. 2, 2-1957, pp. 170-173.

*Primary Examiner*—Howard N. Goldberg

*Attorney, Agent, or Firm*—Connolly and Hutz

[57] ABSTRACT

A wet mill for producing very finely ground end products with particles in the low micron range from feed particles sized up to about 300 microns has a cylindrical rotor closely inserted within a cylindrical vessel with a pumping space between the bottom of the rotor and the vessel and a narrow annular gap between the side walls of the rotor and vessel. The particles to be ground are introduced into the pumping space from which they are forcefully discharged by rotating vanes on the bottom of the rotor to pass upwardly through the grinding medium in the annular gap. The grinding medium is retained in the annular gap by the force of the pumping action and if thrown up may be caught on a screen over the outlet while the finer ground particles are discharged.

12 Claims, 4 Drawing Figures

ANNULAR GRINDING MILL

BACKGROUND OF THE INVENTION

This invention relates to a grinding mill in which a cylindrical rotor floats concentrically within a cylindrical vessel in a vertical orientation. The side walls of the rotor and vessel define between them an annular gap or space within which feed particles are comminuted by forceful interaction with particles of a grinding medium. The particles to be ground are introduced in fluidized form and forcefully interact with and contact the grinding medium to reduce their particle size.

A great number of conventional types of ball and wet grinding mills are now in use. In addition to the older forms in which the agitating shaft has stirring elements in the form of rods disposed transversely of the axis of the shaft and spaced a distance therefrom, there are also ball mills in which the agitating shaft carries disk-shaped stirring elements distributed throughout its height. In a recent type known as annular compartment mill, the agitator has a stirring shaft having the form of a hollow cylinder. In addition to the stirring rods mounted on the shell of the hollow cylinder, the grinding compartment also may have on its inside wall rods that project into the annular grinding compartment between the rows of rods distributed throughout the height of the agitator (German Pat. No. 1,233,237). See also U.S. Pat. Nos. 3,149,789 and 3,185,398.

Regardless of whether the stirring elements of the wet grinding or ball mills are constructed as rods or disks, it is still an open question as to whether the reduction in size is accomplished by impact and by attrition between the grinding media, by attrition alone, or by extremly high shearing strain of the carrier liquid. The ball and wet grinding mills of known construction also exhibit in the ground material a broad particle size distribution. Therefore, in the majority of cases where the ground material should have a narrow particle size distribution, i.e. minimal parts of coarse and overly finely grounded materials, the ball mills or wet mills of known construction do not product satisfactory results.

German Auslegeschrift DT-AS No. 1,184,188 describes a ball mill in which a smooth-walled cylinder rotates concentrically or eccentrically within a vessel to grind particles in the gap between the rotor and vessel which are pumped through the gap in an aqueous slurry under differential pressure from an external pump. The structure is somewhat similar to that of the ball mill described in U.S. Pat. No. 3,423,032, which has a restriction at the bottom of the annular gap, small enough to prevent the grinding balls from dropping through it. There is, however, no retainer at the bottom of the annular gap in the mill described in DT-AS No, 1,184,188 and its external pump must generate enouth velocity to pass all components of the slurry upwardly through the gap. This necessitates relatively high pumping pressure and there is still no assurance that the particles will not drop backwardly through the gap and lodge under the rotor.

SUMMARY

It is, therefore, an object of the present invention to provide a grinding mill in which a narrow particle size distribution can be attained in the ground particles by promoting substantially uniform movement of the grinding medium and ground material through the annular gap between the rotor and the drum. Such uniform motion is promoted by pumping elements on the bottom of the rotor which uniformly distribute and propel the slurry upwardly through the annular gap in which a substantially laminar helical flow pattern, and prevent the grinding medium and the particles to be ground from dropping under the rotor.

These and other objects of the invention are promoted by utilizing a relatively narrow annular gap ranging from about 6–50 mm.—thinner for finer product and wider for coarser product. Since the grinding compartment contains no projecting components, there is in this compartment a well-ordered flow of ground-material suspension in which the particles travel along paths of uniform length until discharged. Thus, there results a narrow dwell time spectrum for the ground material and, hence, a narrow particle size distribution in the ground material.

By constructing the grinding compartment as a narrow annular gap, its volume and, hence, that of the mass of the loosely charged grinding balls or grinding medium filling up this volume, is minimized. The reduced mass of the balls or other grinding medium likewise results in a decrease in the power consumption for the acceleration of the grinding balls or medium during the grinding. On the other hand, the reduced volume of the grinding balls or medium has no detrimental effect on the grinding performance, because substantially the whole charge of grinding media remains in the zone of highest possible grinding effect at all times.

BRIEF DESCRIPTION OF THE DRAWINGS

Novel features and advantages of the present invention will become apparent to one skilled in the art from a reading of the following description in conjunction with the accompanying drawing wherein similar reference characters refer to similar parts and, the same reference numerals refer to the same parts and letter suffixes merely differentiate between the same parts in different embodiments in which.

DESCRIPTION OF THE PREFERRED EMBODIMENTS

Figure 1:
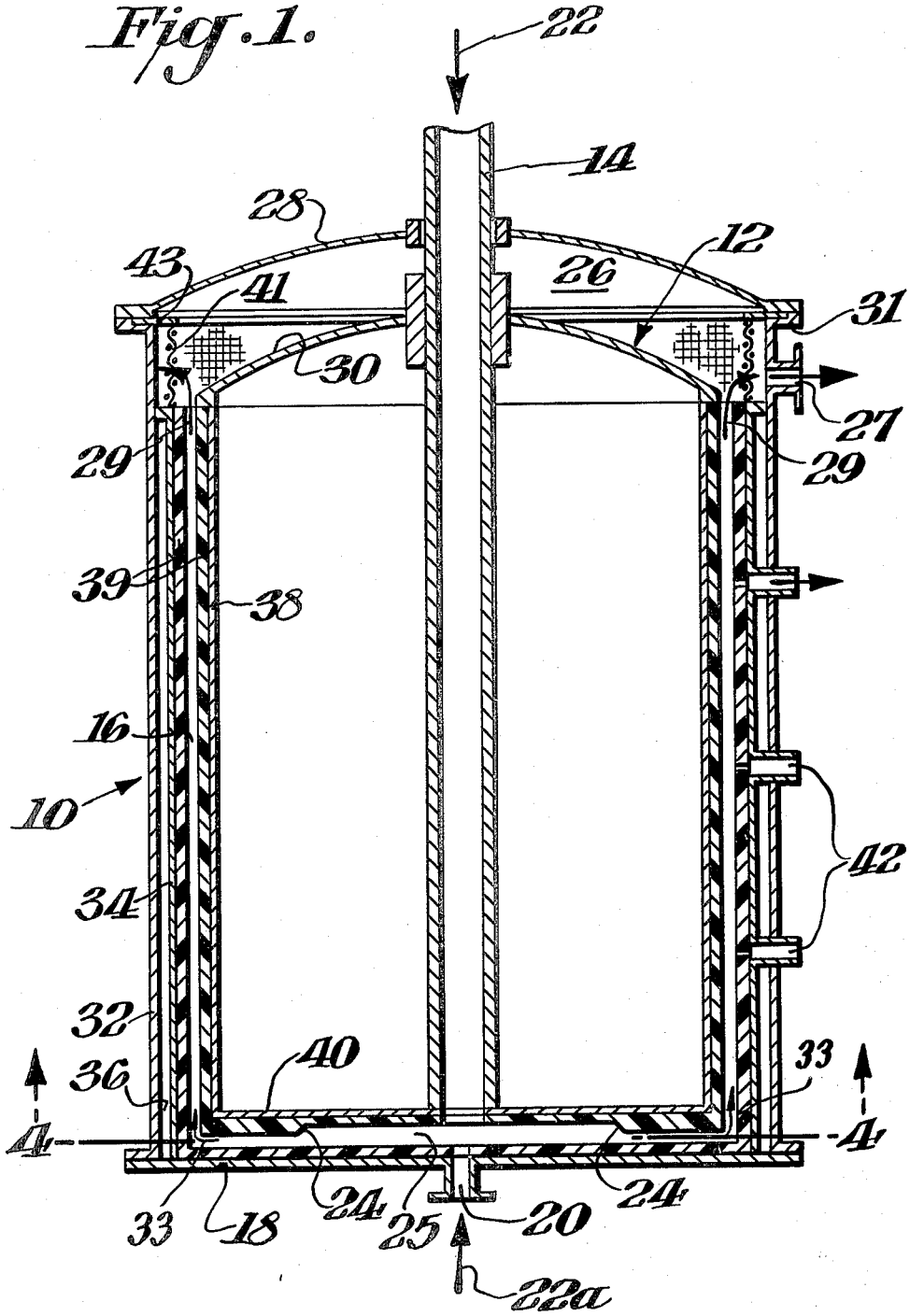
FIG. 1 is a cross-sectional view in elevation of a wet grinding mill which is one embodiment of this invention.

The wet grinding mill shown in FIG. 1 has vertically mounted grinding vessel 10 in which there is provided a pivotally mounted rotor 12 serving as an agitator. The rotor 12 is designed as a hollow cylinder and is traversed by a hollow shaft 14 on which it is overhung above the grinding drum 10 in a manner not shown. Between the shell of the rotor 12 and the cylindrical interior of the grinding drum 10 opposite thereto there is formed as a grinding compartment an annular gap 16 charged with grinding medium (not shown).

The grinding vessel 10 has a flat bottom 18 and has in the center a feed inlet 20 designed to introduce the material to be ground, a to be ground-material suspension, or a fluid fed to the material being ground by means of an external pump (not shown). The charging of the mill with a material to be ground or with grinding medium, especially in the case of a ground material that tends to sediment as a suspension, may also be accomplished from above in the direction of the arrow 22 through a stand pipe (not shown) traversing the hollow shaft 14, or through the bottom in the direction of arrow 22A.

The bottom of the rotor 12 is provided with vanes 24 as in a pump wheel or impeller which extend radially from near the center of the shell and, hence, to the annular gap 16. These vanes 24 are mounted in the manner of an impeller wheel of a pump and serve to convey the ground material or the ground-material suspension from the feed inlet 20 to the annular gap 16. As a result of the pressure applied to the ground material, the latter is conveyed upwardly inside the annular gap 16 to a collector 26 during the grinding, so that it can be discharged above the rotor 12 from a product outlet 27 made radially (or nearly tengentially in larger mills) in the grinding drum 10.

Figure 4:
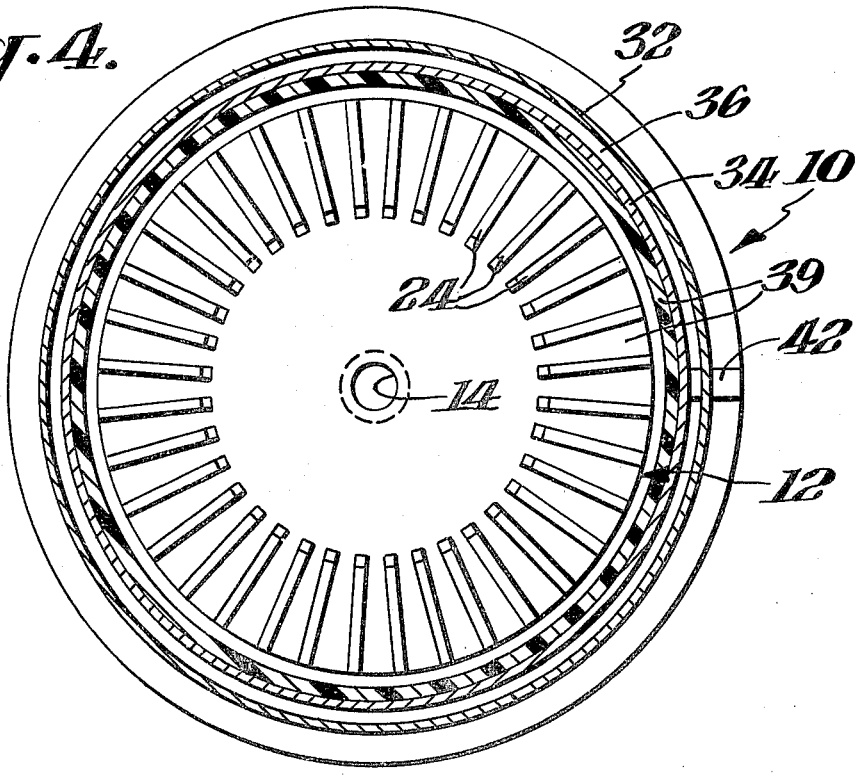
FIG. 4 is a cross-sectional view taken through FIG. 1 along the lines 4—4.

FIG. 4 shows thirty-six impeller vanes 24 on the bottom of rotor 12 which uniformly impel or propel the slurry fed into pumping space 25 radially outwardly and upwardly in the direction of arrows 33 through annular gap 16. Such pumping action also maintains the grinding medium or balls suspended within annular gap 16 and do not allow the medium or material to be ground to lodge under the bottom of rotor 12 in space 25. Any number or configuration of pumping elements 24 may be utilized so long as it provides the aforedescribed function. The effluent passing upwardly and outwardly from slot 16 in the direction of arrows 29 is filtered by screen 41 concentrically mounted within vessel 10 between an extension 43 of its upper flange 31 and the inside wall 34 of vessel 10. The size of openings in screen 41 depends on the particle size of the grinding medium and may, for example, range from about 10 to 100 mesh size.

At one end the collector 26 is defined by a flanged cover 28 of grinding vessel 10 and at the other end by the upper end 30 of the rotor 12. The vessel cover 28 and the upper end 30 of the rotor 12 have a convex shape. About the periphery of the grinding vessel 10 is a cooling jacket 32 which forms with the drum wall 34 an annular channel 36 through which a coolant may flow.

On the side facing the grinding compartment, the jacket 38 and the bottom 40 of the rotor 12, as well as the drum wall 34 and the drum bottom 18, are lined with a wear-resistant plastic material 39, e.g., polyurethane. Polyurethane is particularly suited if grinding balls are employed which are made of an oxide ceramic material.

Preferably, the radial width of the grinding compartment 16 is three to twenty times greater than the diameter of the grinding medium. It ranges, for example, from about 6–50 mm. Distributed throughout the height of the grinding compartment, are a plurality of obstructable openings 42 for adding dispersing agents into the interior of vessel 10.

Figure 2:
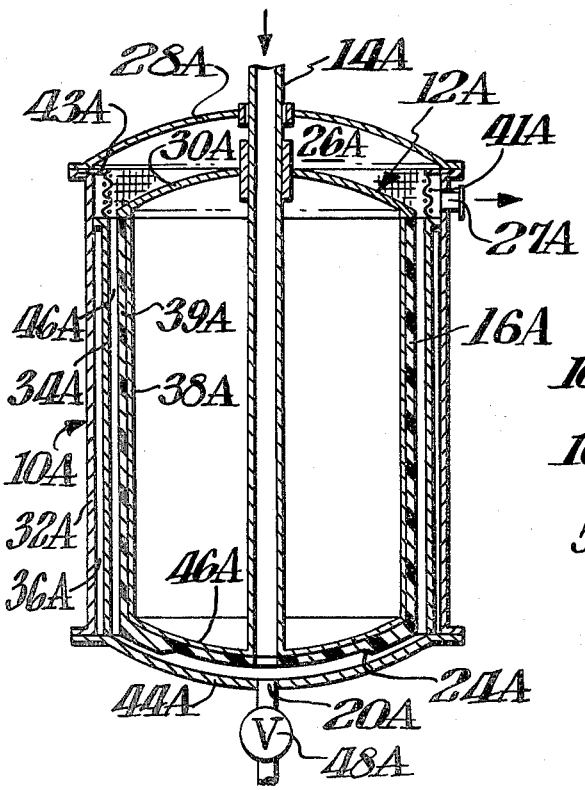
FIG. 2 is another cross-sectional view in elevation of another grinding mill which is another embodiment of this invention.

The wet grinding mill of FIG. 2 differs from that of FIG. 1 in that the vessel bottom 44A and the bottom 46A of the rotor 12A, as well as the vessel cover 28A and the upper end 30A of the rotor, have a convex shape. As in FIG. 1, the rotor 12A is overhung in a manner, not shown, by means of a hollow shaft 14A. The feed inlet 20A is connected with the delivery side of a pump 48A.

Figure 3:
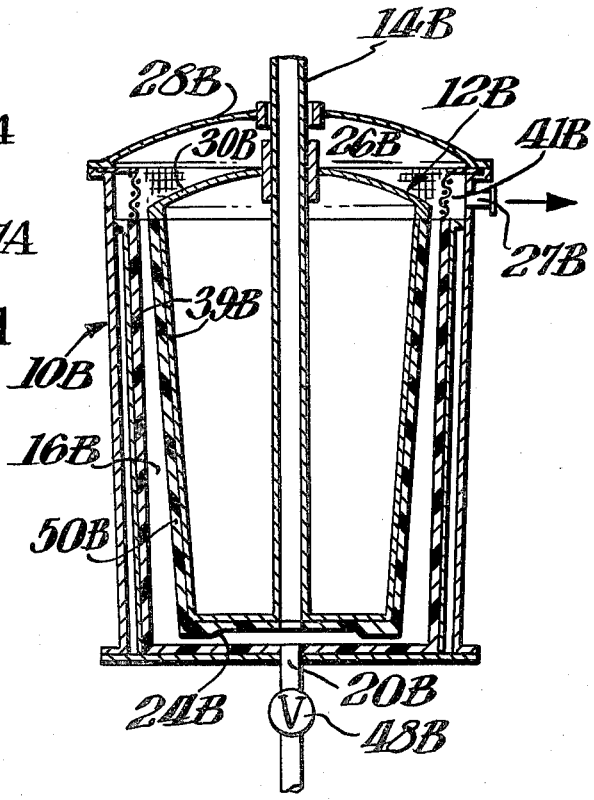
FIG. 3 is a further cross-sectional view in elevation of a wet grinding mill which is a further embodiment of this invention.

While the width of the annular gap 16 and 16A in the illustrative embodiments of FIGS. 1 and 2 is constant, the width of the slot 16B, in the illustrative embodiment of FIG. 3, decreases upwardly, that is, in the direction of conveyance. The decreasing gap width is due to the fact that the shell 50B of the rotor 12B on hollow shaft 14B has an increasing diameter in the direction of conveyance. The inside of the grinding vessel 10B facing the grinding compartment 16B has an increasing diameter also in the direction of conveyance, but with a smaller taper than that of the shell 50B.

The wet grinding mills of FIGS. 1–3 may be operated without a built-in separating screen under certain conditions. Because of the high centrifugal acceleration in the grinding zone and the absence of inner projections, which could produce axial accelerations or turbulence, the grinding balls or media which have a higher specific weight, are only floated to a small extent by the upwardly flowing ground material-suspension. The number of grinding media particles leaving the mill with the material is also dependent upon the throughput in liters per minute, the viscosity and the specific weight of the ground-material suspension. Outside the mill the grinding media may be separated from the ground material on a separate screening machine if they are not to remain in the suspension for any subsequent grinding state. The discharged grinding media and, possible, also the worn-out media must be replaced periodically or continually. This may be done in any of the following ways:

(a) from above through an opening (not shown) in the vessel cover 28, if the density of flow of the ground-material suspension is low and grinding media with a high specific weight are used;

(b) through the stand pipe in the hollow shaft 14 of the rotor 12; or (c) by means of a diaphragm or surge pump parallel to ground material suspension into the feed inlet 20.

It is advisable to start the mill according to the invention without grinding medium. It is added during operation. The dispersing agents to be fed through the openings 42 (FIG. 1) are substances which are active at the interfaces, such as polyacrylates, polyphosphates, etc., which are fed to the ground material during the grinding, particularly in the case of large mills, so as to maintain the required viscosity. A dosing injection pump may be employed for this purpose.

Experience has shown that the wet grinding mill according to the invention not only exhibits a high degree of efficiency during the actual grinding for the pulverization of solid single particles, but also during the dispersion in liquids of solid matters that are finely divided but difficult to wet or are heavily agglomerated.

The following is a list of representative dimensions for a wet grinding mill as shown in FIG. 1, which is suitable for grinding limestone from a particle size of about 15 to 45 microns to an average of less than 1 micron. Suitable grinding media for such use and other operating characteristics are later described.

TABLE I

Representative Mill Dimensions (a) Rotor OD = 1.540 m (lined with about 10 mm of polyurethane)

(b) Annular grinding zone width = 10 mm.

(c) Shell ID = 1.560 m (lined with about 10 mm of polyurethane)

(d) Total rotor height ≧ 2.000 m.

(e) Effective rotor height = 2.000 m.

(f) Effective grinding zone volume = 97.4 l = 25.7 gal.

(g) Installed power = 240 KW = 325 HP (h) Rotor speed, angular = 220 rpm, surface = 17.7 m/sec.

Representative operating variables for the above described mill are as follows for ginding limestone:

TABLE II

Operating Characteristics for Grinding Limestone

| | | | |
|---|---|---|---|
| (a) Grinding elements | composition | = | synthetic alumina |
| | size | = | average 1.0mm (range; 0.5–1.5mm) |
| | quantity | = | 90% of effective grinding zone volume on a bulk volume basis (range; 70–100%) |
| (b) Feed, | composition = limestone | | |
| | particle size average about 15 μm., max about 45 μm | | |
| | fluid vehicle = water | | |
| | concentration, vol. | = | 49% (range: 33–68%) |
| | wt. | = | 72% (range: 57–85%) |
| | slurry density = 1.82gm./cc.(range 1.57–2.16) | | |
| (c) Additives | = | | 0.10–0.25% Dispex N40, Allied Colloids Inc., on feed solids basis. |
| (d) Feed rate | = | | 2100 l/h = 555 gal/h |
| (e) Effective residence time (assuming 35 l/min feed rate, 3 subsequent grinding steps, and grinding zone 90% filled with media of 40% voids) = 3 × 1.25 min. = 3.75 min. | | | |

The following is a forecast of operating and apparatus variables which are believed to apply to future variations of apparatus and operation.

TABLE III

Operating and Structural Variations (a) Annular grinding zone width should not vary with rotor diameter, but will vary with grinding application; thin zone for fine product, wide for coarse (range: 6–50 mm.).

(b) Grinding elements should vary with zone width and range ⅓–1/20 of the zone width.

(c) Rotor surface speed should not vary significantly with rotor diameter for a given application, vary rpm.

(d) Effective rotor height will be held to a small multiple of rotor diameter, ranging from about 1 to 2.

(e) Power to scale on effective volume basis as KW/l. or HP/gal.

(f) Feed concentrations are best expressed on a volume percent basis, because mineral feed particle densities vary so widely; ranging at least from about 1.4 gm/cc for coal to about 5.2 for hematite.

An amount of limestone of approximately 44 micron particle size was ground in a unlined mill of a type described in FIG. 1. Extremely effective results were obtained particularly in the particle distribution which is as follows:

Particle Size Distribution Ground Limestone

Max. 4 microns

90% finer 2 microns

55% finer 1 micron

30% finer 0.5 micron

We claim:

1. A grinding mill for reducing the size of particles of material in a fluidized suspension form by forceful interaction with a particulate grinding medium, comprising a cylindrical vessel having smooth internal side walls, a cylindrical rotor having a smooth external side wall, the cylindrical rotor being closely inserted in the cylindrical vessel whereby a narrow annular gap is disposed between the side walls of the rotor and vessel, the rotor and vessel having circular bottoms, rotary means mounting the rotor concentrically with the cylindrical vessel with a pumping space disposed between the bottom of the rotor and the bottom of the vessel, drive means connected to the rotor for rotating it within the vessel, impeller means disposed within the pumping space, the impeller means being constructed and arranged for generating a positive forceful flow of slurry from the pumping space up through the annular gap whereby the grinding medium and particles being ground are substantially prevented from dropping downwardly from the gap into the pumping space and the ground particles are carried upwardly through the gap, and the impeller means comprises a circular array of pumping vanes on the bottom of the rotor disposed within the pumping space.

2. A ginding mill as set forth in claim 1, wherein the pumping vanes comprise a circular array of radial vanes.

3. A grinding mill as set forth in claim 2, wherein the radial vanes are substantially straight.

4. A grinding mill as set forth in claim 3, wherein the radial vanes comprise an annular set of radial vanes.

5. A grinding mill as set forth in claim 1, wherein the radial width of the annular gap is approximately 3 to 20 times of the average diameter of the grinding medium.

6. A grinding mill as set forth in claim 1, wherein the radial width of the annular gap ranges about 6–50 mm.

7. A grinding mill as set forth in claim 1, wherein the radial width of the gap is substantially constant over its entire height.

8. A grinding mill as set forth in claim 1, wherein the inner side walls and bottom of the vessel and the exterior side walls and bottom of the rotor are lined by a plastic material.

9. A grinding mill as set forth in claim 8, wherein the plastic material is polyurethane.

10. A grinding mill as set forth in claim 1, wherein the vessel includes a collecting chamber disposed above the rotor and gap, an outlet connected to the collecting chamber for discharging suspension from the mill, and a screen disposed between the collecting chamber and the outlet for preventing grinding medium from being discharged.

11. A grinding mill as set forth in claim 1, wherein a feeding conduit is connected to the pumping space for feeding material to the mill.

12. A grinding mill as set forth in claim 1, wherein a number of openings are provided in the wall of the vessel for introducing dispersing agents into the gap, and closure means being provided on the openings for sealing them.

* * * * *